US006357173B1

(12) United States Patent
Sofy et al.

(10) Patent No.: US 6,357,173 B1
(45) Date of Patent: Mar. 19, 2002

(54) TREE STAND WITH WATER STORAGE PORTIONS

(75) Inventors: Janet M. Sofy, Troy; Brian Wood, Bloomfield Hills, both of MI (US)

(73) Assignee: HMS Mfg. Co., Troy, MI (US)

( * ) Notice: Subject to any disclaimer, the term of this patent is extended or adjusted under 35 U.S.C. 154(b) by 0 days.

(21) Appl. No.: 09/602,763

(22) Filed: Jun. 23, 2000

(51) Int. Cl.[7] ..... A47G 33/12
(52) U.S. Cl. ..... 47/40.5; 248/524
(58) Field of Search ..... 47/40.5, 79, 65.5; D11/130.1, 146; 248/523, 524

(56) References Cited

U.S. PATENT DOCUMENTS

| | | | | | |
|---|---|---|---|---|---|
| 1,091,000 | A | | 3/1914 | Lyman | |
| 1,110,142 | A | | 9/1914 | Piner | |
| 1,159,353 | A | | 11/1915 | Bergwall | |
| 1,240,376 | A | | 9/1917 | Saucier | |
| 1,401,144 | A | | 12/1921 | Dicks | |
| 1,575,488 | A | | 3/1926 | Jakobey | |
| 1,644,807 | A | | 10/1927 | Zeigler | |
| 2,044,192 | A | | 6/1936 | Templin, Jr. | 248/44 |
| 2,605,067 | A | | 7/1952 | Lindsell | 248/45 |
| 2,681,780 | A | | 6/1954 | Santoro | 248/45 |
| 2,905,414 | A | | 9/1959 | Zierden | 248/44 |
| 2,933,274 | A | | 4/1960 | Mausolf | 248/44 |
| 3,026,075 | A | | 3/1962 | Phelon et al. | 248/48 |
| 3,051,423 | A | | 8/1962 | Wagner et al. | 248/45 |
| 3,298,643 | A | | 1/1967 | Taylor | 248/44 |
| 4,007,901 | A | | 2/1977 | Mancini et al. | 248/526 |
| 4,198,023 | A | * | 4/1980 | Stranzinger | 248/523 |
| 4,254,578 | A | | 3/1981 | Hanfeld | 47/40.5 |
| 4,496,129 | A | | 1/1985 | Waterman et al. | 248/527 |
| 4,541,601 | A | | 9/1985 | Corbisello | 248/516 |
| 4,571,881 | A | | 2/1986 | Lathim | 47/40.5 |
| D287,476 | S | | 12/1986 | Craft et al. | 11/130.1 |
| D289,148 | S | * | 4/1987 | Laslo | D11/146 |
| 4,834,335 | A | | 5/1989 | Attar | 248/526 |
| 4,884,363 | A | | 12/1989 | Sofy | 47/40.5 |
| 4,913,395 | A | | 4/1990 | Juhas | 248/516 |
| 4,989,820 | A | | 2/1991 | Sterling | 248/523 |
| 5,121,897 | A | | 6/1992 | Sofy | 248/527 |
| 5,320,323 | A | | 6/1994 | Clark, Jr. | 248/523 |
| D351,570 | S | | 10/1994 | Fillipp | 11/130.1 |
| 5,467,959 | A | | 11/1995 | Behringer | 248/523 |
| D364,831 | S | | 12/1995 | Fillipp | 11/130.1 |
| 5,484,131 | A | | 1/1996 | Aldrete et al. | 248/527 |
| D368,674 | S | | 4/1996 | Avinger | 11/130.1 |
| 5,551,659 | A | | 9/1996 | Sofy | 248/523 |
| 5,580,026 | A | | 12/1996 | Newcomer | 248/523 |
| 5,725,193 | A | * | 3/1998 | Adams | 248/523 |
| 5,743,505 | A | * | 4/1998 | Sofy | 248/346.01 |
| 5,743,508 | A | | 4/1998 | Fiveash | 248/527 |
| 5,779,215 | A | | 7/1998 | DeMasi | 248/523 |
| 5,794,379 | A | * | 8/1998 | McKay | 47/41.01 |
| 5,797,579 | A | | 8/1998 | Krinner | 248/523 |
| 5,918,849 | A | | 7/1999 | Bliss | 248/523 |
| 5,938,168 | A | * | 8/1999 | Adams | 248/523 |
| D428,357 | S | * | 7/2000 | Fillipp et al. | D11/130.1 |
| D443,227 | S | * | 6/2001 | Sofy et al. | D11/130.1 |

FOREIGN PATENT DOCUMENTS

| | | |
|---|---|---|
| DE | 3421733 | 12/1985 |

* cited by examiner

*Primary Examiner*—Peter M. Poon
*Assistant Examiner*—Jeffrey L. Gellner
(74) *Attorney, Agent, or Firm*—Howard & Howard

(57) ABSTRACT

A tree stand (10) comprising a base (12) extending about an axis (A) and a tree support wall (14) extending about the axis (A) upwardly from the base (12) to an open top. The top of the support wall (14) and the open top of a receptacle (24) define trunk support portions (26) and liquid storage portions (28) disposed about the axis (A). The trunk support portions (26) are disposed radially closer to the axis (A) than the storage portions (28) and the support portions (26) are intermingled with and alternate the storage portions (28) circumferentially about the axis (A) and the wall (14) undulates continuously and circumferentially about the axis (A) through the support (26) and storage (28) portions.

20 Claims, 5 Drawing Sheets

FIG-5
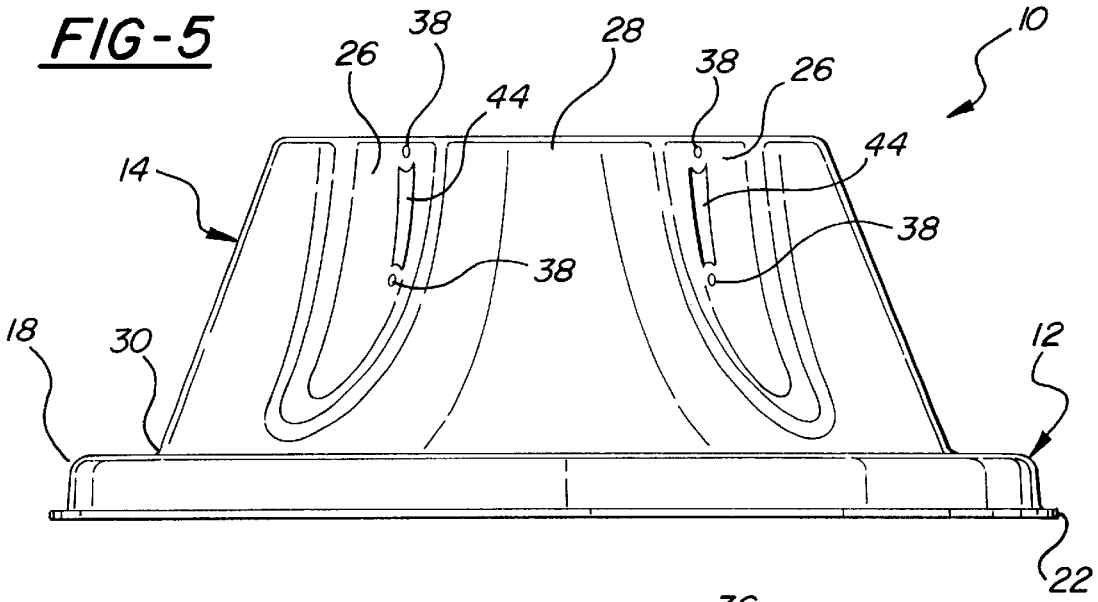
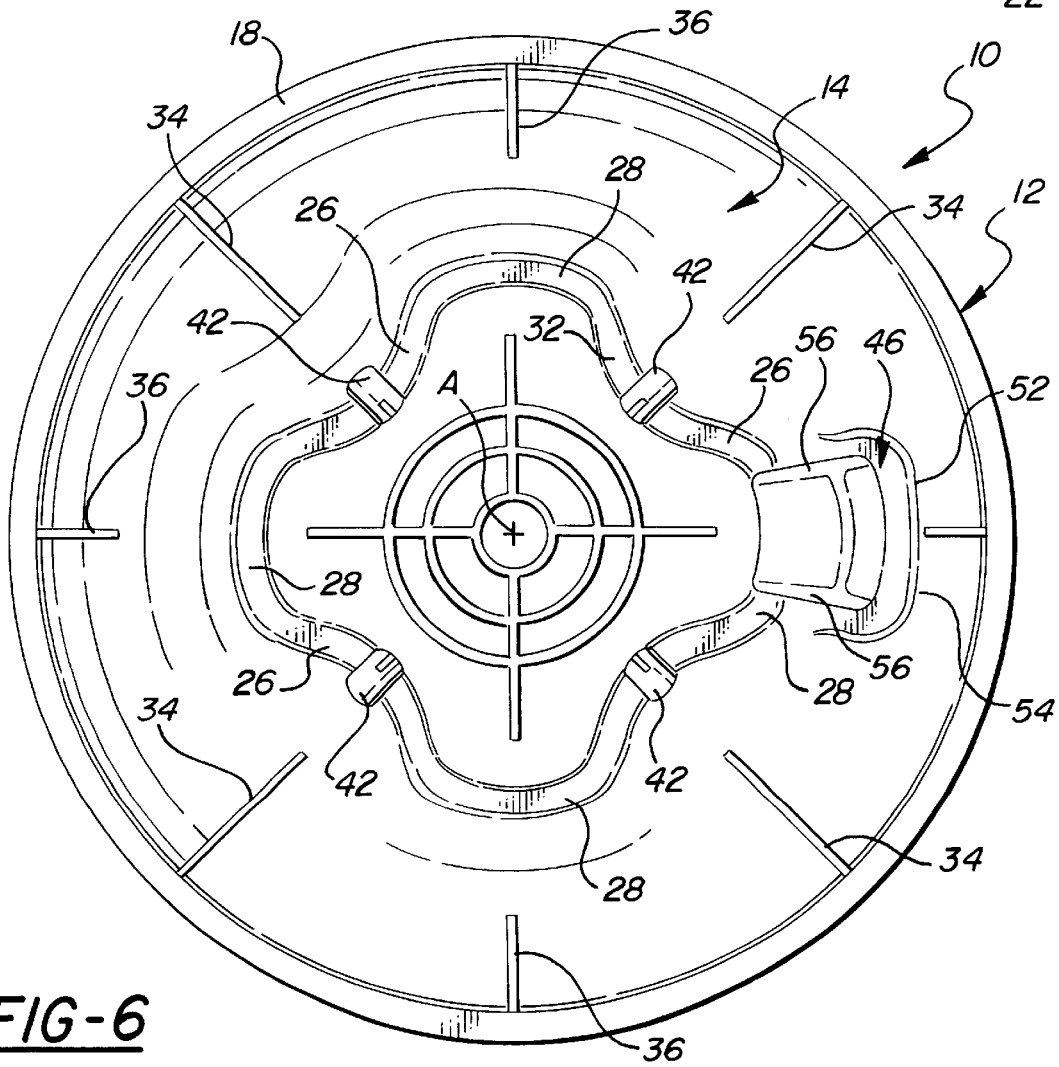
FIG-6

TREE STAND WITH WATER STORAGE PORTIONS

BACKGROUND OF THE INVENTION

1. Field of the Invention

The subject invention relates to a tree stand of the type used to support a Christmas tree.

2. Description of the Prior Art

The type of tree stand to which the subject invention pertains supports a tree in an upright posture and includes a base extending about an axis for supporting a tree on a support surface with a tree support wall extending about the axis upwardly from the base to a top. A receptacle is disposed within the support wall and has an open top for receiving the trunk of a tree. The top of the support wall and the open top of the receptacle define trunk support portions and liquid storage portions disposed about the axis. Such tree stands are disclosed in U.S. Pat. Nos. 4,884,363 and 5,121,897 to Sofy and U.S. Pat. No. Des. 351,570 to Fillip. These stands have a relatively large base for stability and extend to a narrow collar for surrounding and supporting the tree trunk in the interior receptacle. In order to securely stabilize the tree trunk the collar closely surrounds the tree trunk, which makes it difficult to fill the receptacle when the stand is supporting the tree trunk. In order to ease this filling problem a fill-opening has been placed in the side of the stand to extend into the receptacle, as shown in U.S. Pat. No. 2,044,192 to Templin, Jr. However, the narrow collar still limits the amount of liquid that the receptacle can hold to nourish the tree.

SUMMARY OF THE INVENTION AND ADVANTAGES

The subject invention provides a tree stand for supporting a tree in an upright posture comprising a base extending about an axis for supporting a tree on a support surface and a tree support wall extending about the axis upwardly from the base to a top. A receptacle is disposed within the support wall and has an open top for receiving the trunk of a tree. The top of the support wall and the open top of the receptacle define trunk support portions and liquid storage portions disposed about the axis the trunk support portions being disposed radially closer to the axis than the storage portions.

Accordingly, the subject invention provides a tree stand wherein the trunk of the tree is closely surrounded yet the volume of the receptacle holding the liquid to nourish the tree is significantly increased.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 is a side view taken along line 5—5 of FIG. 2;

FIG. 6 is a bottom view of FIG. 4;

DETAILED DESCRIPTION OF THE PREFERRED EMBODIMENT

Figure 1:
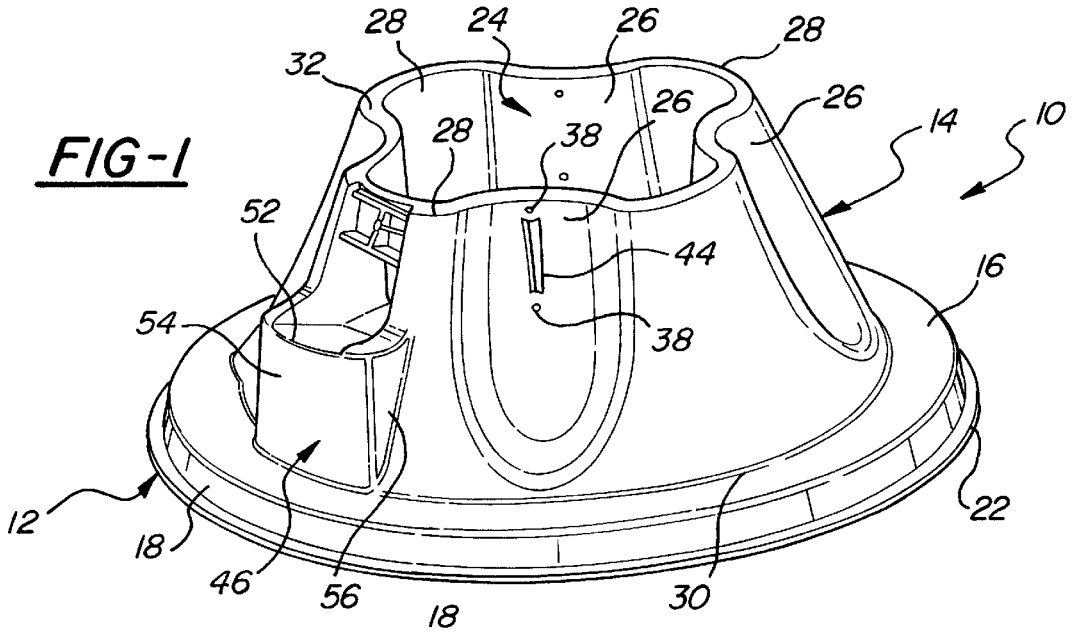
FIG. 1 is perspective view of the tree stand of the subject invention.
Figure 2:
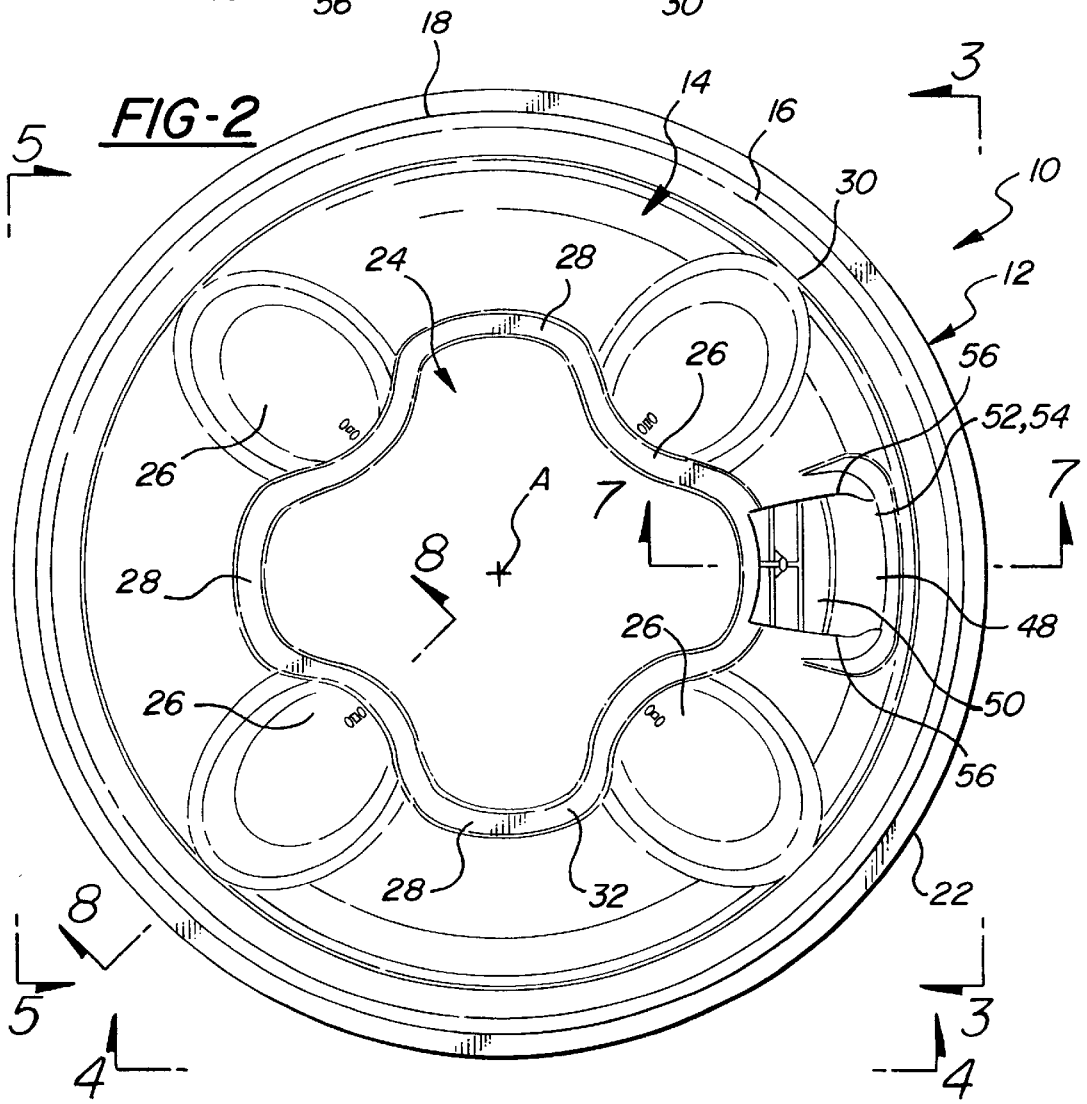
FIG. 2 is a top view of the tree stand.
Figure 3:
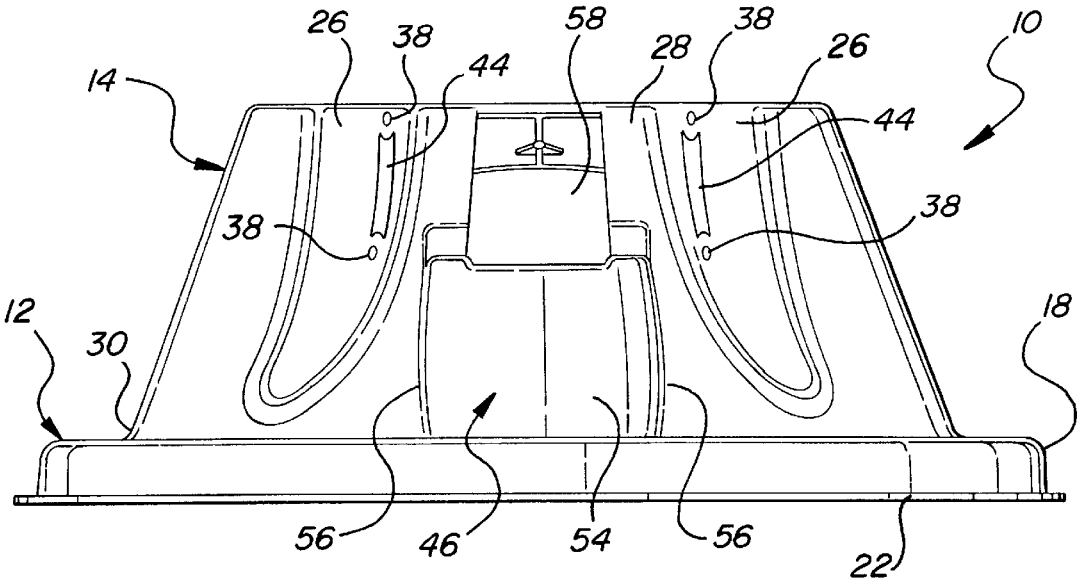
FIG. 3 is a side view taken along line 3—3 of FIG. 2.
Figure 4:
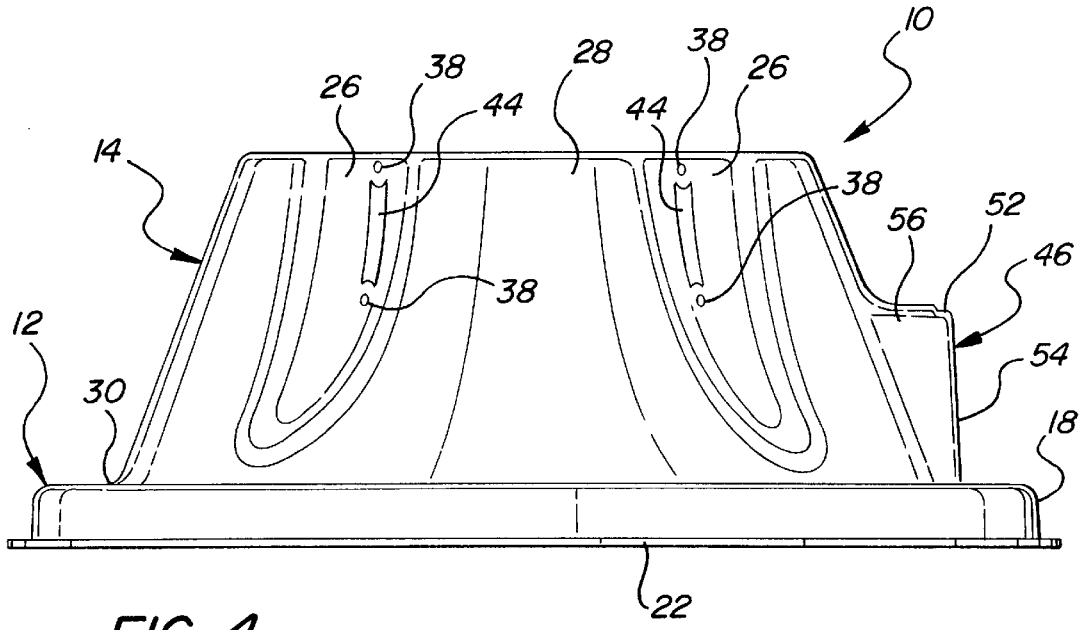
FIG. 4 is a side view taken along line 4—4 of FIG. 2.
Figure 7:
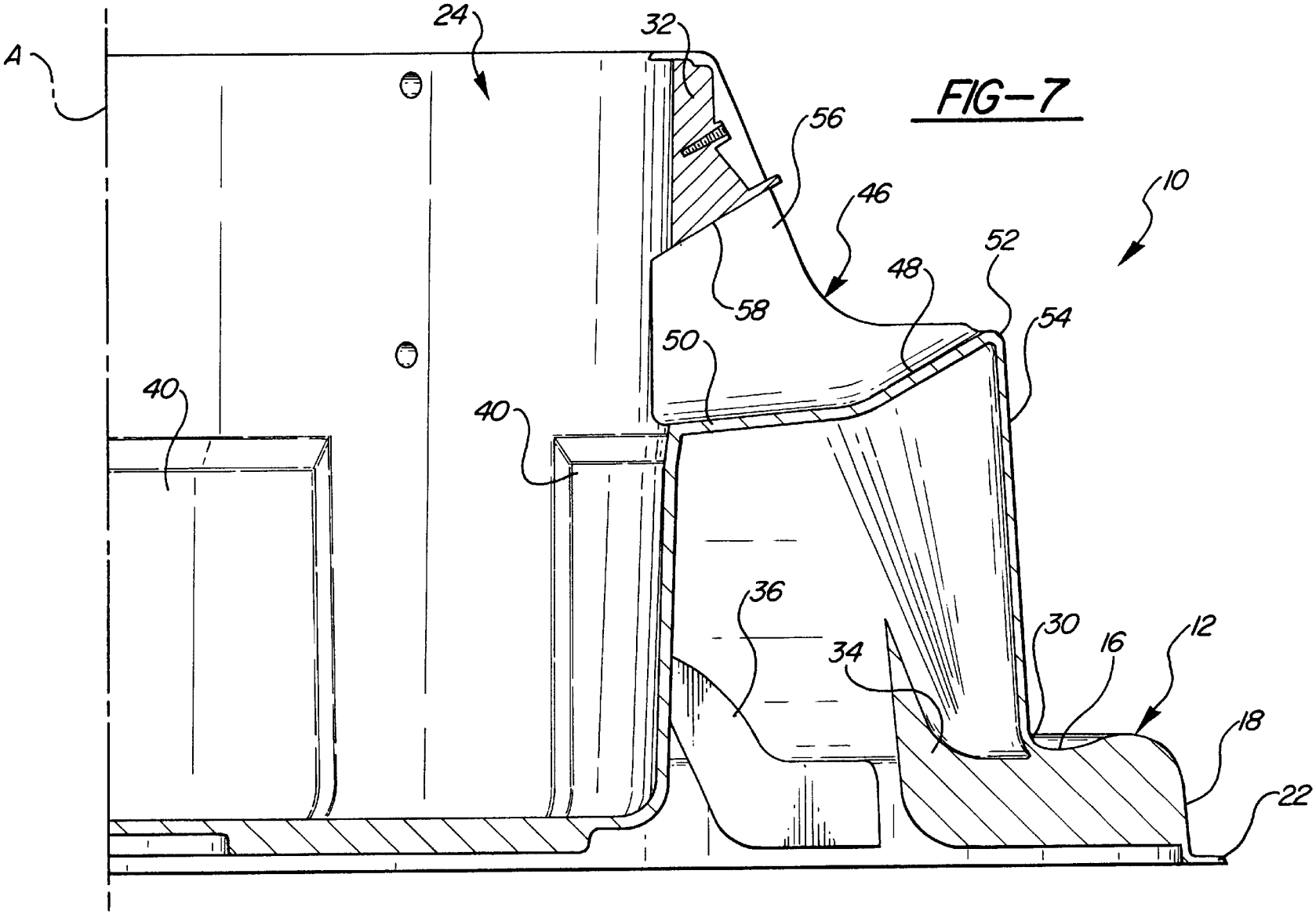
FIG. 7 is a cross sectional view taken along line 7—7 of FIG. 2.
Figure 8:
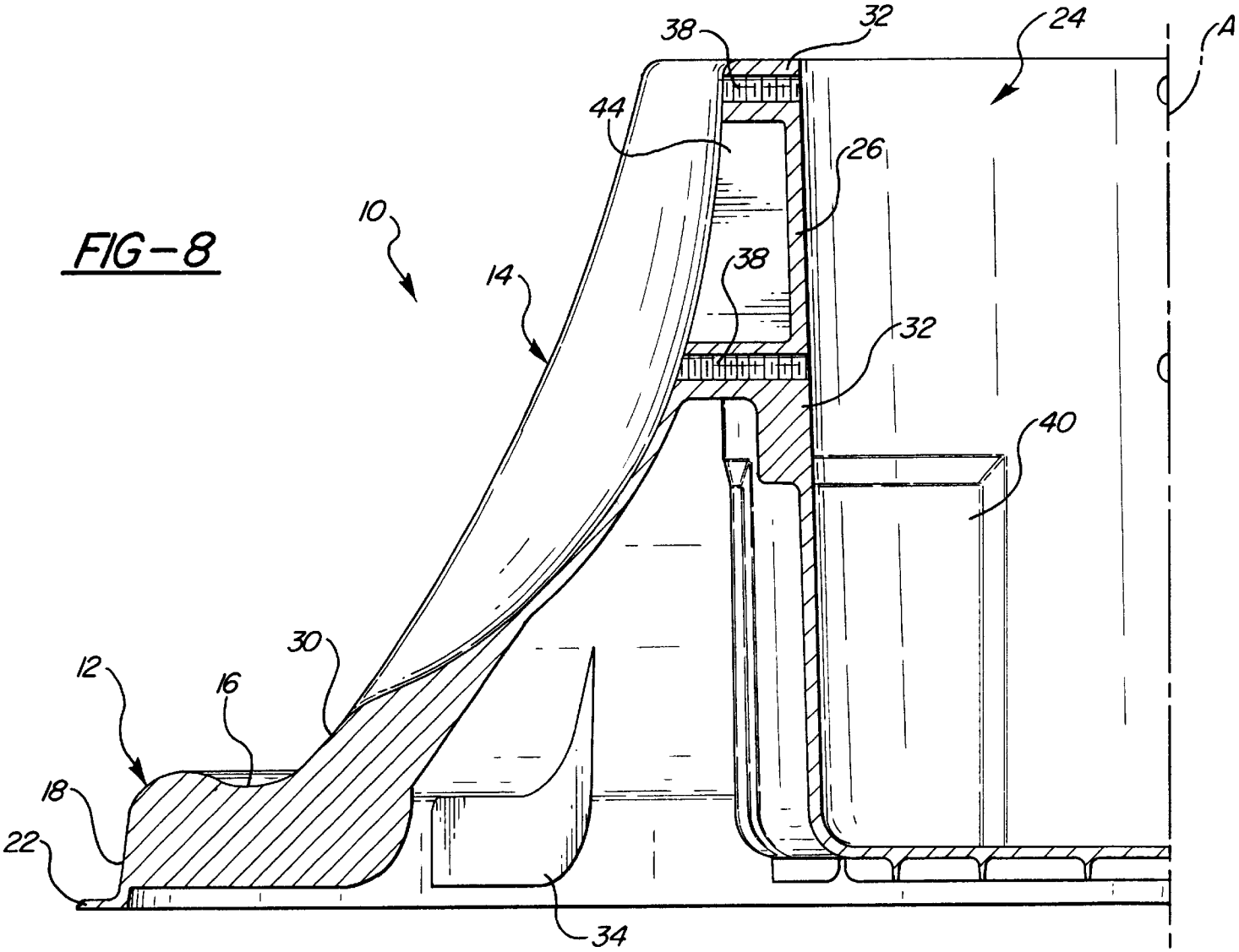
FIG. 8 is a cross sectional view taken along line 8—8 of FIG. 2.

Referring to the Figures, wherein like numerals indicate like or corresponding parts throughout the several views, a tree stand for supporting a tree in an upright posture is generally shown at 10.

The stand 10 includes a base, generally indicated at 12, extending about an axis (A) for supporting a tree on a support surface, as is well known at the holiday season. A tree support wall, generally indicated at 14, extends about the axis (A) upwardly from the base 12 to an open top. The base 12 defines a trough 16 extending circumferentially about the axis (A) at the juncture thereof with the wall 14 and a downwardly extending annular ring 18. A flat flange 22 extends radially from the ring 18. To contain water, the tree stand 10 includes a receptacle, generally indicated at 24, disposed within the support wall 14 and having an open top for receiving the trunk of a tree. The trough 16 catches water from overfilling the tree stand with water to nourish the tree trunk.

The support wall 14 and the open top of the receptacle 24 define trunk support portions 26 and liquid storage portions 28 disposed about the axis (A). The stand 10 is characterized by the trunk support portions 26 being disposed radially closer to the axis (A) than the storage portions 28. The trunk support portions 26 are intermingled with and alternate the storage portions 28 circumferentially about the axis (A). In other words, the wall 14 undulates continuously and circumferentially about the axis (A) through the support 26 and storage 28 portions. The base 12 extends in a circle about the axis (A) and the wall 14 extends in a continuous or endless path 30 about the axis (A) adjacent the base 12. The storage portions 28 are defined by the wall 14 extending upwardly in a truncated manner from the circle 30 to the top of the wall 14. Each of the support portions 26 are defined by the wall 14 extending arcuately inwardly and upwardly relative to the adjacent storage portions 28 and from the circle 30 to define a bulbous and concave pocket. The top of the receptacle 24 and the top of the wall 14 are joined into a solid section 32 whereby the top of the receptacle 24 and the top of the top of the wall 14 undulate together continuously and circumferentially about the axis (A) through the support 26 and storage 28 portions. The receptacle 24 has a generally cross shaped (+) or clover leaf shaped cross section that is vertically constant in radial dimension, i.e., the receptacle walls are generally vertical, whereas the support wall 14 is generally truncated. The tops of the receptacle 24 and the wall 14 are in the same plane as are the upper extremities of the support 26 and storage 28 portions. An alternative description is that the storage portions 28 bulge outwardly from and between the support portions 26.

The wall 14 and the receptacle 24 are spaced radially from one another to define a space below the solid section 32 and reinforcing ribs 34 and 36 are disposed on the inside of the wall 14 in that open space. A first set 34 of the ribs are disposed in the space and are radially aligned with the respective support portions 26 and a second set 36 of the ribs are radially aligned with the respective storage portions 28, the first set 34 of ribs being longer than the second set 36 of the ribs. The ribs join the ring 18 and the wall 14 for reinforcing the base 14. The receptacle 24 also includes circumferentially spaced panels 40 projecting radially thereinto.

The support portions 26 have holes 38 extending through bosses 42 in the support portions 26 for receiving braces in the form of threaded bolts (not shown) to engage and stabilize a tree trunk in the receptacle 24. A pair of the holes 38 are spaced vertically in each of the solid sections 32 in each of the pockets of the support portions 26 and a recess 44 is disposed vertically between each pair of the holes 38 and extends into the solid section 32. As alluded to above, the holes 38 are pre-threaded or threaded as they receive threaded bolts.

The tree stand also includes a liquid fill-opening, generally indicated at 46, in at least one of the storage portions 28 for filling the receptacle 24 with a liquid, i.e., water. The fill-opening 46 has a bottom 48 and 50 extending downwardly and opening into the receptacle 24. The bottom has two parts, one 48 extends downwardly at a first angle from a lip 52 to a second level 50 disposed at a second angle which extends into the receptacle 24. A lip wall 54 extends upwardly from the base 12 to the lip 52 that joins the bottom 48 and 50. The fill-opening 46 includes sides 56 extending upwardly from the bottom 48 and 50 thereof and a roof 58 interconnecting the sides 56, the roof 58 slants downwardly into the receptacle 24.

Obviously, many modifications and variations of the present invention are possible in light of the above teachings. The invention may be practiced otherwise than as specifically described within the scope of the appended claims.

What is claimed is:

1. A tree stand for supporting a tree in an upright posture comprising;

a base extending about an axis for supporting a tree on a support surface, a tree support wall extending about said axis upwardly from said base to a top, a receptacle having a closed bottom disposed within said support wall and having an open top for receiving the trunk of a tree, and said tops of said support wall and said open top of said receptacle defining trunk support portions and liquid storage portions disposed about said axis, said support portions having holes extending therethrough for receiving braces to engage and stabilize a tree trunk in said receptacle, said tops of said support wall and said receptacle being disposed in the same plane along with the upper extremities of said trunk support portions and said liquid storage portions, said trunk support portions being disposed radially closer to said axis than said liquid storage portions.

2. An assembly as set forth in claim 1 including a liquid fill-opening in at least one of said storage portions for filling said receptacle with a liquid.

3. An assembly as set forth in claim 1 wherein said wall undulates endlessly and circumferentially about said axis through said support and storage portions.

4. An assembly as set forth in claim 3 wherein said base extends in circle about said axis and said wall extends in an endless path about said axis adjacent said base.

5. An assembly as set forth in claim 4 wherein said storage portions are defined by said wall extending upwardly in a truncated manner from said circle to said top of said wall, each of said support portions being defined by said wall extending inwardly and upwardly relative to said adjacent storage portions and from said circle to define a bulbous and concave pocket.

6. An assembly as set forth in claim 5 including a liquid fill-opening in at least one of said storage portions for filling said receptacle with a liquid, said fill-opening having a bottom and extending downwardly and opening into said receptacle.

7. An assembly as set forth in claim 6 wherein said fill-opening is defined by a lip wall extending upwardly from said base to a lip joining said bottom.

8. An assembly as set forth in claim 7 wherein said bottom extends downwardly at a first angle from said lip to a second level disposed at a second angle which extends into said receptacle.

9. An assembly as set forth in claim 6 wherein said top of said receptacle and said top of said wall are joined into a solid section whereby said top of said receptacle and said top of said top of said wall undulate together continuously and circumferentially about said axis through said support and storage portions.

10. An assembly as set forth in claim 9 wherein said wall and said receptacle are spaced radially from one another to define a space below said solid section, and including reinforcing ribs disposed on the inside of said wall in said space.

11. An assembly as set forth in claim 9 wherein said receptacle includes circumferentially spaced panels projecting radially thereinto.

12. An assembly as set forth in claim 9 including a pair of said holes spaced vertically in said solid sections in each of said pockets and a recess disposed vertically between each pair of said holes and extending into said solid section.

13. An assembly as set forth in claim 12 wherein said holes receive threaded bolts.

14. An assembly as set forth in claim 9 wherein said base defines a trough extending circumferentially about said axis at the juncture thereof with said wall and a downwardly extending ring.

15. An assembly as set forth in claim 14 wherein said wall and said receptacle are spaced radially from one another to define a space below said solid section, and including reinforcing ribs and disposed on the inside of said wall in said space, a first set of said ribs being disposed in the space and radially aligned with said respective support portions and a second set of said ribs being radially aligned with said respective storage portions, said first set of ribs being longer than said second set of said ribs.

16. An assembly as set forth in claim 15 wherein said receptacle has a generally cloverleaf shaped cross section.

17. An assembly as set forth in claim 18 wherein said fill-opening includes sides extending upwardly from said bottom and thereof and a roof interconnecting said sides, said roof slanting downwardly into said receptacle.

18. An assembly as set forth in claim 16 wherein said clover shaped cross section is vertically constant in radial dimension.

19. An assembly as set forth in claim 1 wherein said trunk support portions are intermingled with said storage portions.

20. An assembly as set forth in claim 19 wherein said trunk support portion alternate with said storage portions circumferentially about said axis.

* * * * *